US005983698A

United States Patent [19]

Tseng

[11] Patent Number: 5,983,698

[45] Date of Patent: Nov. 16, 1999

[54] EASY REMOVED DIE CORE DEVICE USED FOR COLD SWAGING

[76] Inventor: Shao-Chien Tseng, No.130, Sec. 2. Yang-Shin Rd., Yang-Mei, Taoyuan 326, Taiwan

[21] Appl. No.: 09/025,492

[22] Filed: Feb. 18, 1998

[51] Int. Cl.[6] ..... B21B 25/00

[52] U.S. Cl. ..... 72/466.9; 72/398; 29/894.362

[58] Field of Search ..... 72/150, 370.01, 72/370.06, 370.08, 370.13, 370.14, 370.23, 370.24, 398, 465.1, 466.8, 466.9, 471, 367.1, 369; 29/894.362; 425/393

[56] References Cited

U.S. PATENT DOCUMENTS

| | | | |
|---|---|---|---|
| 1,120,271 | 12/1914 | Buescher | 72/398 |
| 2,633,978 | 4/1953 | Brown | 72/466.9 |
| 2,723,426 | 11/1955 | Pelley | 425/393 |
| 3,814,565 | 6/1974 | Cahour et al. | 425/392 |
| 4,428,220 | 1/1984 | Rammesten | 72/370.05 |
| 4,502,308 | 3/1985 | Kelly | 72/370.06 |
| 4,746,386 | 5/1988 | Sato et al. | 425/393 |
| 4,930,338 | 6/1990 | Tokura | 72/370.06 |

*Primary Examiner*—Joseph J. Hail, III
*Assistant Examiner*—Ed Tolan
*Attorney, Agent, or Firm*—Pro-Techtor International Services

[57] ABSTRACT

An easy removed die core device used for cold swaging comprising a mandrel, two end supporting members, an outer spring and a plurality of inner springs, wherein, the mandrel is extended into the position between the two end supporting members which are provided with coaxial stepped stubs, each stub is provided with a C shaped locking ring, so that the inner and the outer springs can engage each with a stub in a coaxial arrangement, and can resist the swaging force by their inherent resiliency; the end supporting members are provided each with a cam lever which is used to mount or dismantle the inner and the outer springs between the end supporting members in a easy way, while the threads on the outer spring has on the lateral shoulders thereof cutting angles, so that when the springs are drawn out of the inner wall of the shaped workpiece, the rough edges on the inner wall formed during forging can be planed simultaneously thereby, thus the objects of easy removing the die core device and rough edges planing can be obtained.

5 Claims, 7 Drawing Sheets

EASY REMOVED DIE CORE DEVICE USED FOR COLD SWAGING

BACKGROUND OF THE INVENTION

1. Field of the Invention

The present invention is related to an easy removed die core device used for cold swaging, and especially to an easy removed die core device, wherein, by means of a plurality of screw typed outer and inner tension springs and by the nature that the diameter of any ring on the threads of the springs can be elastically reduced when it is compressed, the swaging force exerted on the wall of the blank to be forged can be resisted by the elastic die core device, and after swaging, the elastic die core device can be taken out of the inner wall of the shaped workpiece easily, and the rough edges on the inner wall formed in swaging can be planed by the angled edges of a plurality of rings of the threads on the outer spring.

2. Description of the Prior Art

In processing metallic workpieces, forging techniques have been well used to increase the strength of the workpieces, normally, workpieces which are abrasion resistant, compression resistant, shearing resistant etc . . . are used for forging. The ways of forging available in the field include the rotary swager, the stationary-spindle swager, the creeping-spindle swager, the alternate-blow swager and the disclosing swager, etc . . . ; such existing swaging techniques can be used for processing a solid forged workpiece 1 (as shown in FIG. 1) and a hollow pipe forged workpiece 10 (as shown in FIG. 2); however, a hollow pipe forged workpiece must be examined for the easiness for extending therethrough a die core before swaging, and for the feasibility that the die core can be taken out of the inner wall of the hole of the shaped workpiece, these two points generally prevent some hollow workpieces with special shapes from swaging for enhancing their strength.

Therefore, we now take the hub used on a wheel of a bicycle as an exemplifying workpiece for explanation:

As shown in FIG. 1, there is depicted the above mentioned conventional technique in cold forging the solid workpiece 1, wherein, a gradually proceeding forging step must be used in order to gradually forge and shape the solid workpiece 1 to form an arciform exterior wall 11, two end annular portions 12 of a hub of the wheel 13, then the annular portions 12 are drilled to form the necessary hooking holes 14, the hub of the wheel 13 is further processed with a milling knife 15 to form a bore with an inner wall 161, and the solid workpiece 1 thereby is formed a shaped wheel hub 16; however, this forging and milling method is overly material and cost consumptive, and it has been added with a boring process, in this view, the outstandingly high cost of material as well as processing has left to it a big problem; moreover, in the pipe walls of a completed wheel hub 16 (referring to FIG. 3), grainfiber flow 17 thereof has been observed with a metallographic microscope and has found that the wheel hub 16 made through the process of boring had damaged partial of the grainfiber flow 17, this has rendered the crystallines after swaging to have had uneven distribution of stress, therefore, the strength of the completed wheel hub 16 can not give the desired requirement of compression strength, this is one of the disadvantages of such a conventional technique.

Secondly, As shown in FIG. 2, there is depicted the above mentioned conventional technique in cold forging the hollow pipe workpiece 10 for forming a completed wheel hub 16, wherein, the rotary swager as mentioned above is used in the forging process, it is impossible to place a die core into the bore 101 of the wheel hub 16 having an arciform inner wall 104 (classified as one of the abovementioned special shapes) by the forging process, hence only smaller forging pressure can be used by way of progressive rotary swaging on the hollow pipe workpiece 10 to gradually swage and shape an arciform exterior wall 102, the arciform inner wall 104 and two end annular portions 103 to form a shaped wheel hub 106, then the annular portions 103 are drilled to form the necessary hooking holes 105,the shaped workpiece is thereby completed by such a conventional method; however, this forging method on the hollow pipe workpiece 10 is proceeded without a die core, so that the capability of the hollow pipe workpiece 10 for resisting rotary swaging force is smaller although the hollow pipe workpiece 10 does not require a milling process for boring which can increase the cost of material and processing, in this view, only the hollow pipe workpiece 10 with thinner wall can be forged by this method, and those hollow pipe workpieces require higher compressive strength can not, this makes an undesired limitation of such a method; moreover, a shaped wheel hub 106 form with the hollow pipe workpiece 10 has been found with a metallographic microscope that, on the wall portion thereof where a larger forging action is applied on (such as is shown in FIG. 4), the grainfiber flow 107 therein shows weakness by a crowed phenomenon in which acute angles are in the grainfiber flow 107 by virtue that the inner wall 104 does not have a resistive die core, the crystallines thereof where the swaging force is more concentrated are very weak, such area of the shaped wheel hub 106 is most fragile and subjected to breakage, this is the most troublesome problem of such a method.

SUMMARY OF THE INVENTION

In view of the above statement, the conventional forging processes are testified being difficult in obtaining hollow shaped articles with high compressive strength, for these technical problems, the inventor of the present invention provides an easy removed die core device used for cold swaging to overcome these technical problems.

Therefore, the primary object of the present invention is to provide a die core device for cold swaging used to support the wall of a blank and to resist swaging pressure, and being easily removed from the bore or hole of the shaped workpiece after swaging, the die core does not need a processing step for moulding it to have an embossment for shaping the workpiece to be swaged.

Another object of the present invention is to provide a die core device for cold swaging, the die core can be easily taken out of the inner wall of a shaped workpiece by an axial drawing force and by the elastical reducing action in the diameter of the rings of the threads on the screw type springs of the die core device.

Another object of the present invention is to provide a die core device for cold swaging, by the die core device, rough edges on the inner wall formed during forging can be planed by the angled edges of the rings of the threads on the outer spring when the die core device is drawn out. So that the wall surfaces of the shaped workpiece with a special shape can be very neat, and an additional milling process which is difficult to execute after swaging can be omitted.

To obtain the above mentioned objects, the present invention is endued with the following features:

1. Two end supporting members thereof are provided with a plurality of inner as well as outer coaxial springs, the inner sides of the two end supporting members are provided with a plurality of stepped stubs which are provided respectively with peripheral grooves for mounting therein two C shaped locking rings, so that the inner and the outer coaxial springs can be well mounted between the two end supporting members.

2. The two end supporting members each is provided with a central through hole, a slit and a cam lever are left on one side of each of the two through holes, when a mandrel and the springs are inserted in the through holes, these cam levers can be used to reduce through holes to keep firmness of the die core device placed in the hole of the blank before swaging, and can allow easy removing of the die core device from the inner wall of the shaped workpiece.

3. One of the two end supporting members is used to hang the outer spring, while the other is used to hang the multiple inner springs coaxially arranged, these inner and outer springs can be conveniently detached or assembled.

4. The multiple inner and outer springs in the inner wall of the blank arranged coaxially are all screw typed tension springs with rectangular cross sections, when they are not pulled, all the rings of the threads on the outer springs; are tightly closed to one another, the threads of the springs are arranged to screw clockwisely and counterclockwisely alternatively one with another, so that when the wall of the blank bears the swaging pressure, the spring can absorb various swaging force on various areas of the wall, and thereby the requirement that the wall is going to be endued with a given arciform shape can be afforded.

5. Each ring of the threads on the outer spring with rectangular cross sections has on the lateral shoulders thereof cutting angles, so that when the springs are drawn out of the inner wall of the shaped workpiece, the rough edges on the inner wall formed during forging can be planed.

6. The diameters of the springs can be reduced during drawing them; axially out by resisting force of the inner wall thereto and by elasticity thereof, so that they can be taken out very easily.

The present invention will be apparent in the above stated objects and characteristics after reading the detailed description of a hub used on a wheel of a bicycle as a preferred embodiment thereof in reference to the accompanying drawings.

DETAILED DESCRIPTION OF THE PREFERRED EMBODIMENT

Figure 1:
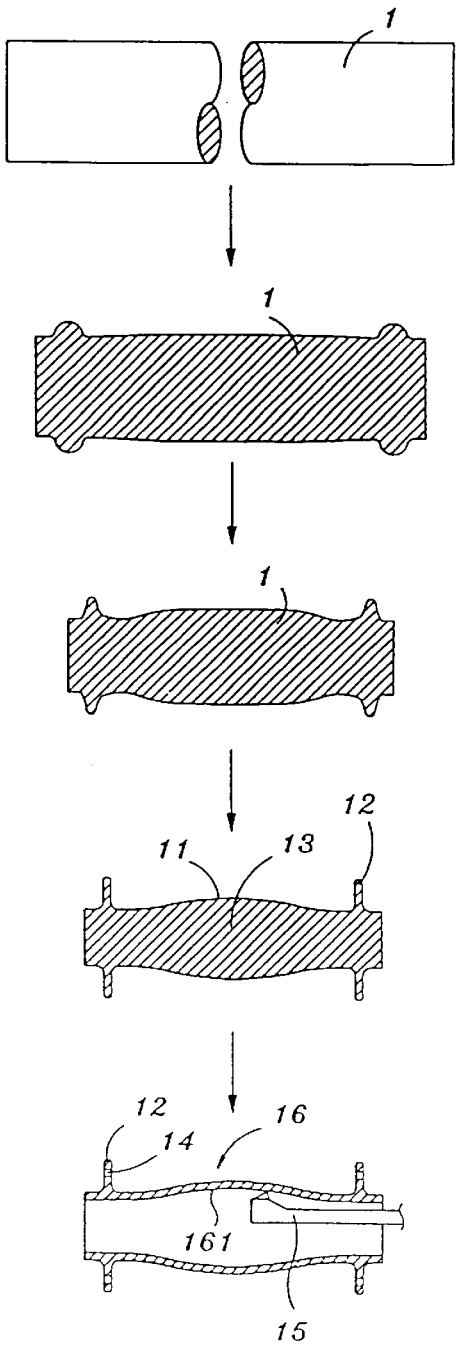
Fig. 1 (PRIOR ART)
FIG. 1 is a process flow diagram showing a hollow wheel hub shaped by forging with a solid forged workpiece in a conventional technique.
Figure 2:
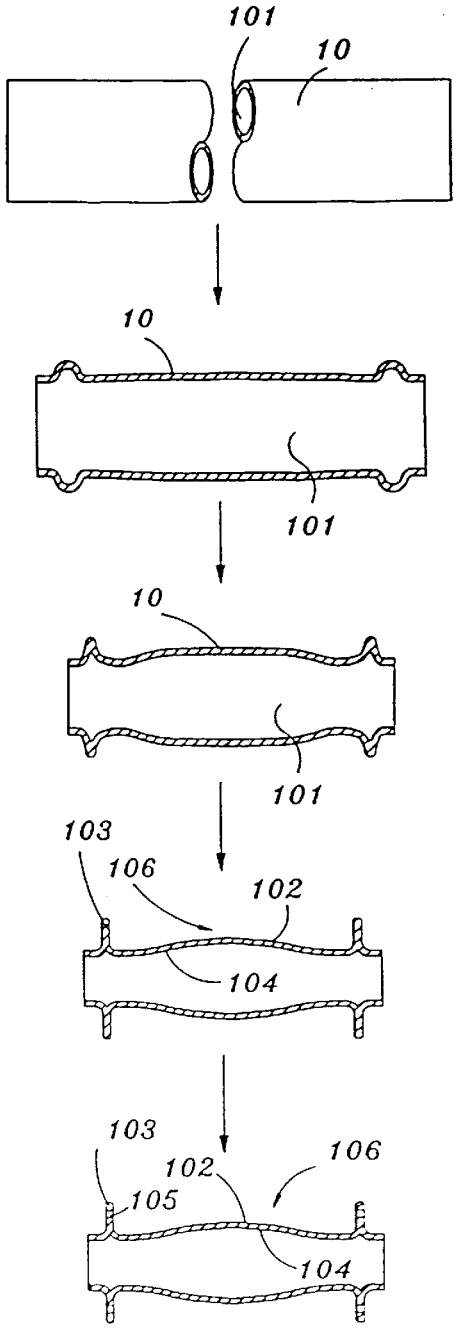
Fig. 2 (PRIOR ART)
FIG. 2 is a process flow diagram showing a hollow wheel hub shaped by forging with a hollow pipe forged workpiece in a conventional technique.
Figure 3:
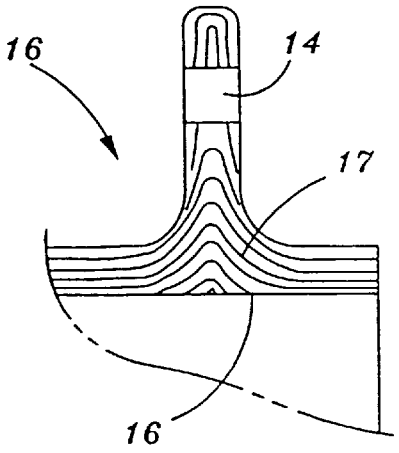
FIG. 3 is a schematic view showing partial grainfiber flow in a conventional hollow wheel hub as shown in FIG. 1.
Figure 4:
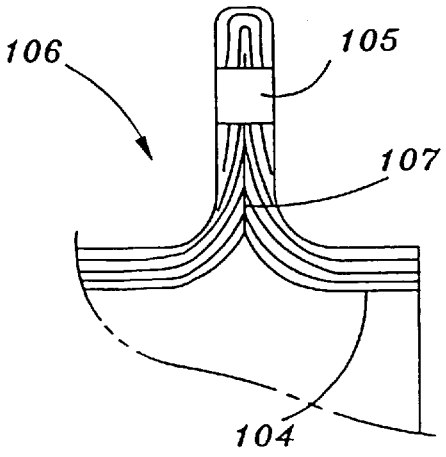
FIG. 4 is a schematic view showing partial grainfiber flow in a conventional hollow wheel hub as shown in FIG. 2.
Figure 5:
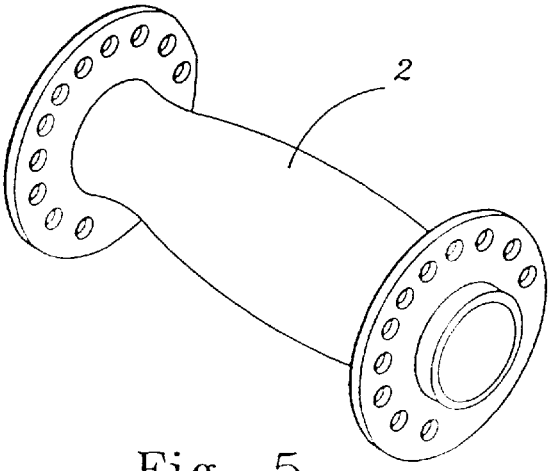
FIG. 5 is a perspective view of the wheel hub of a bicycle to be made by the cold forging method stated in the present invention.
Figure 6:
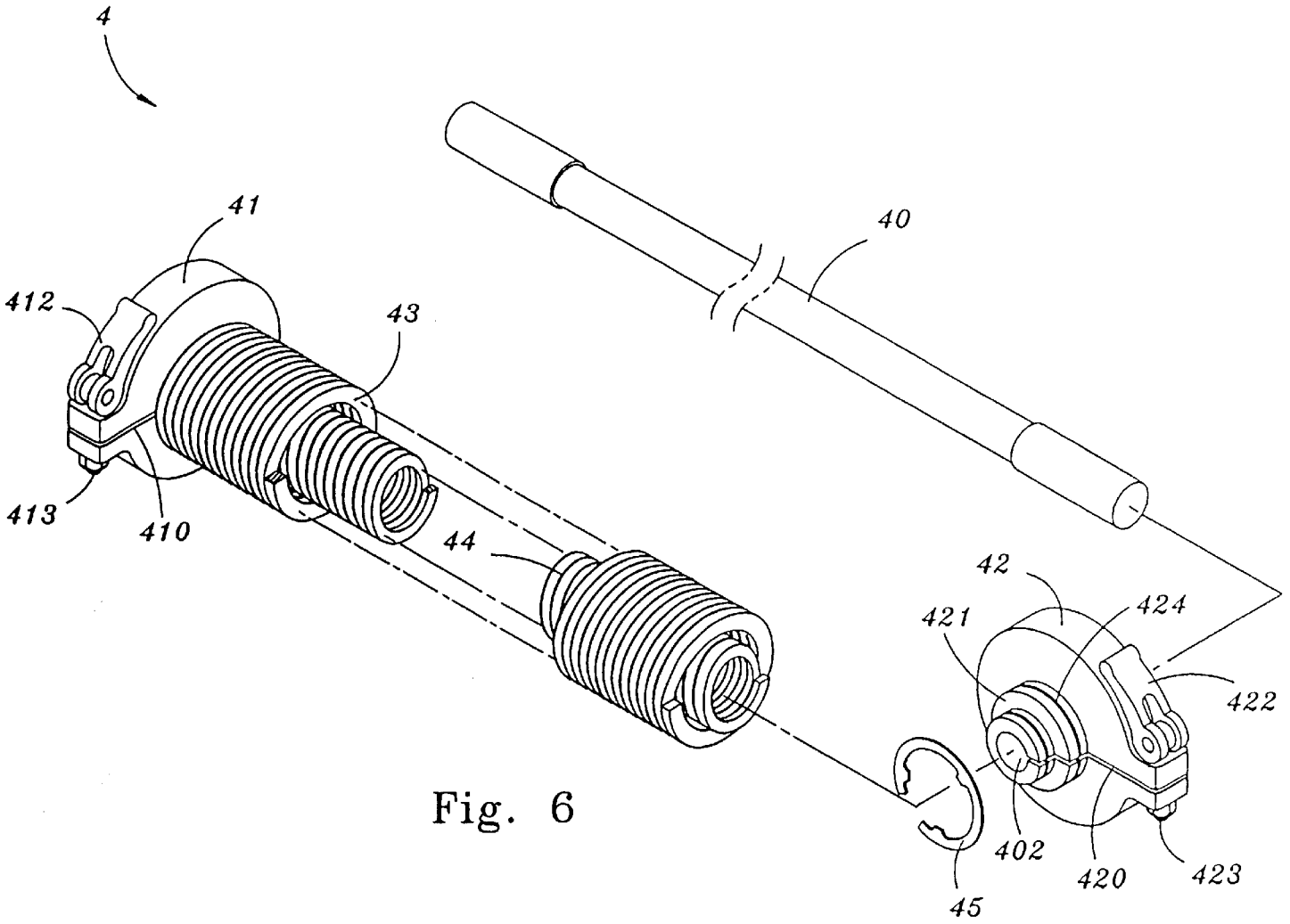
FIG. 6 is a perspective view showing assembling of the die core device of the present invention.
Figure 7:
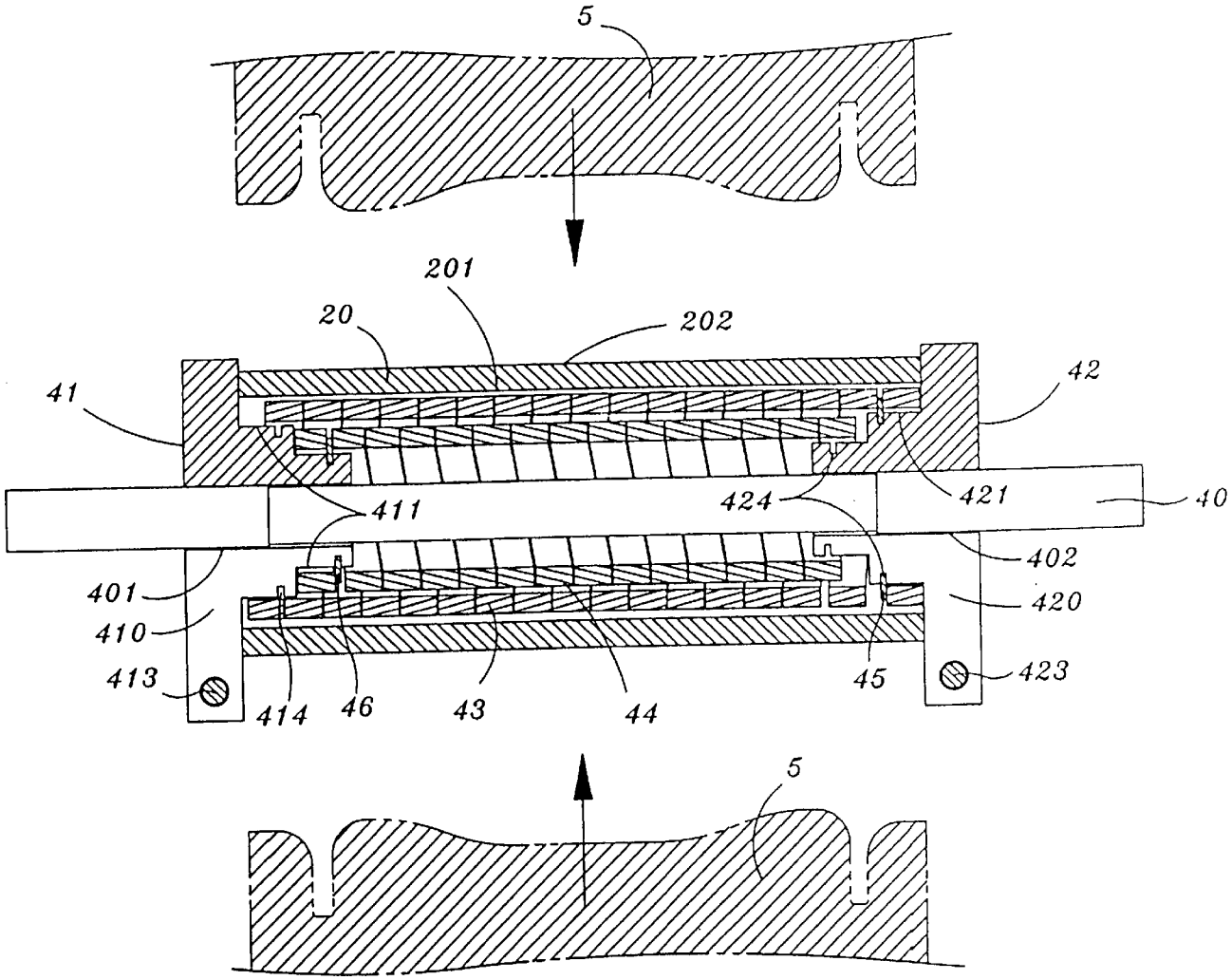
FIG. 7 is a sectional view showing insertion of the die core device of the present invention into a hole of a blank to be forged.
Figure 10:
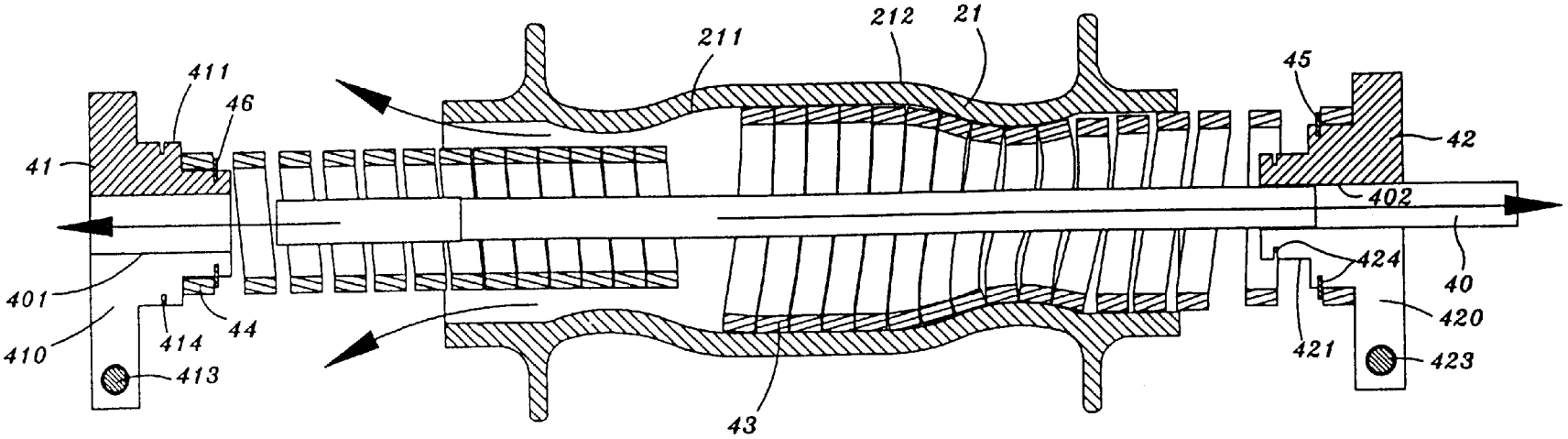
FIG. 10 is a sectional view showing removing of the inner as well as the outer springs and the mandrel of the present invention when in the state as shown in FIG. 9.

Referring firstly to FIG. 5 of the present invention and taking the hub 2 used on a wheel of a bicycle as an exemplifying workpiece to be forged for specification:

The present invention uses a pipe like blank 20 (as shown in FIG. 7) as a workpiece to be forged, it can be processed at one's will by the rotary forging or swaging as stated in the background of the present invention, the main feature of the present invention is to add a die core device 4 (as shown in FIG. 6) to forge into an exterior wall 202 of the hub 2 (which is in the shape of a straight pipe before swaging) and an inner wall 201 of a hole of the blank 20 into arciform shaped exterior wall 212 and the inner wall 211 of the hole (as shown in FIG. 10).

Referring to FIG. 6 of the present invention, the die core device 4 is comprised of: a mandrel 40, two end supporting members 41, 42, an outer spring 43 and a plurality of inner springs 44, wherein (also referring to FIG. 7):

The inner sides of the two end supporting members 41, 42 are provided with stepped stubs 411, 421, the centers of the two end supporting members 41, 42 are provided with two through holes 401, 402, a slit 410 (420) is left on one side of each of the two through holes 401, 402, a clamping rod 413 (423) is provided on one side of each of the slits 410, 420, the clamping rods 413, 423 are cooperately connected with two cam levers 412, 422 for controlling expansion as well as reducing of the two through holes 401, 402 respectively.

The amount of steps of the stepped stubs 411, 421 of the two end supporting members 41, 42 can be changed in according to the amount of the springs (such as the springs 43, 44) to be used, the diameters of the stepped stubs 411, 421 are smaller than the inner diameters of their corresponding springs 43, 44, and the stepped stubs 411, 421 are provided respectively with peripheral grooves 414, 424 for mounting respectively C shaped locking rings 45 and 46.

The outer spring 43 and the inner spring 44 are all screw typed tension springs, when they are not pulled, all the rings of the threads on the outer spring 43 and the inner spring 44 are tightly closed to one another, the lengths of the outer spring 43 and the inner spring 44 depend on the length of the hole of a blank to be extended through thereby, and the cross section of each ring on the threads of the outer spring 43 and the inner spring 44 is in the shape of a rectangle (as shown in FIG. 7).

The amount of the outer spring 43 to be used can only be one, while amount of the inner spring 44 can be one or more than one, and in this embodiment, only one spring 44 is described, but the amount of the inner spring 44 is meant to be more than one (the multiple inner springs 44 are coaxial and have different diameters).

When in mounting (referring together to FIG. 6 and 7), the mandrel 40 is in the first place extended into the hole formed by the inner wall 201 of the blank 20; then a C shaped locking ring 46 is mounted in the peripheral groove 414 suitably provided on the stepped stubs 411 of the end supporting member 41, so that the exterior edge of the C. shaped locking ring 46 is engaged in the gap between the two end most rings of the inner spring 44; and a C shaped locking ring 45 is mounted in the peripheral groove 424 suitably provided on the stepped stubs 421 of the end supporting member 42, so that the exterior edge of of the C shaped locking ring 45 is engaged in the gap between the two end most rings of the outer spring 43; thereby, by placing the end supporting member 41 and the inner spring 44 over one end as well as placing the end supporting member 42 and the outer spring 43 over the other end of the mandrel 40, the two through holes 401, 402 of the two end supporting members 41, 42 are extended through by the mandrel 40, and the inner and the outer springs 43, 44 are coaxially received in the hole formed by the inner wall 201 of the blank 20, then the two cam levers 412, 422 on the two end supporting members 41, 42 are moved to tighten their clamping, thereby the clamping rods 413, 423 are pulled to reduce the gap of the slits 410, 420, and in turn reduce the two through holes 401, 402 on the two end supporting members 41, 42 extended therein by the mandrel 40, in this way, the two end supporting members 41, 42 on the two ends of the mandrel 40 in the hole formed by the inner wall 201 and the inner and outer springs 43, 44 hung on the two end supporting members 41, 42 can be fixedly positioned, therefore, the assembly wherein the die core device 4 being mounted in the inner wall 201 of the hole of the pipe like blank 20 before forging is completed such as is shown in FIG. 7.

Figure 8:
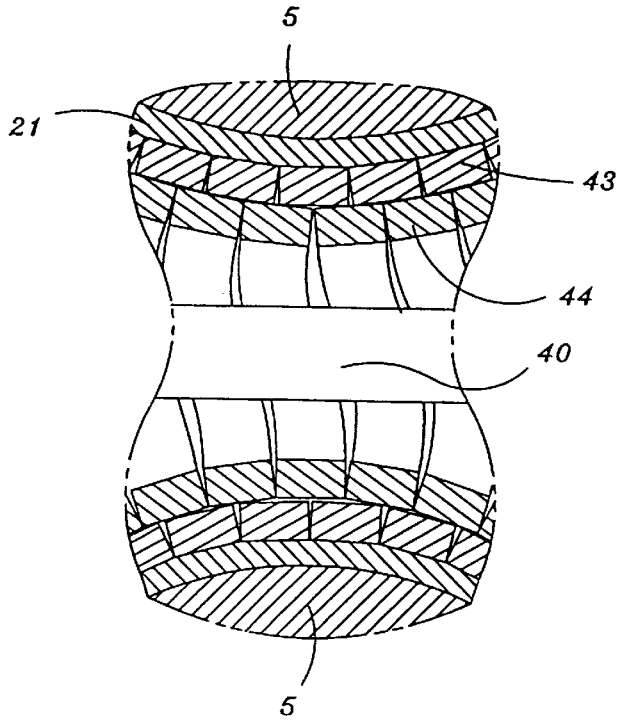
FIG. 8 is a partial sectional view showing a portion in FIG. 7 under forging pressure.
Figure 9:
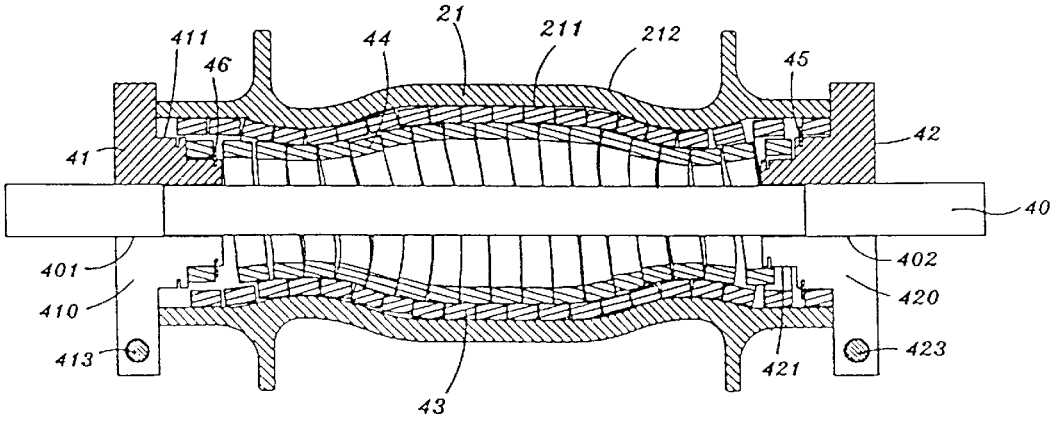
FIG. 9 is a sectional view showing the die core device of the present invention well contained in the hole of the shaped wall after forge moulding.

This can be used to execute a process of swaging with a forging press 5 having a given shape on any type of swaging machine (as shown in FIG. 7), when the forging press 5 presses down the wall of the blank 20 by swaging (as shown in FIG. 8), the inner and outer springs 43, 44 are pressed and can resist the swaging force by their inherent resiliency, so that the wall 201 of the blank 20 can help forming the completed forged article 21 and the shape of the die core device 4 as shown in FIG. 9, at this moment, the elastic restoring forces of the inner and outer springs 43, 44 are smaller than the resistance of the inner wall 211 of the hole of the shaped article 21, so that the inner and the outer springs 43, 44 are restrained by the inner wall 211 of the shaped article 21 but keep their elastic restoring forces.

Figure 11:
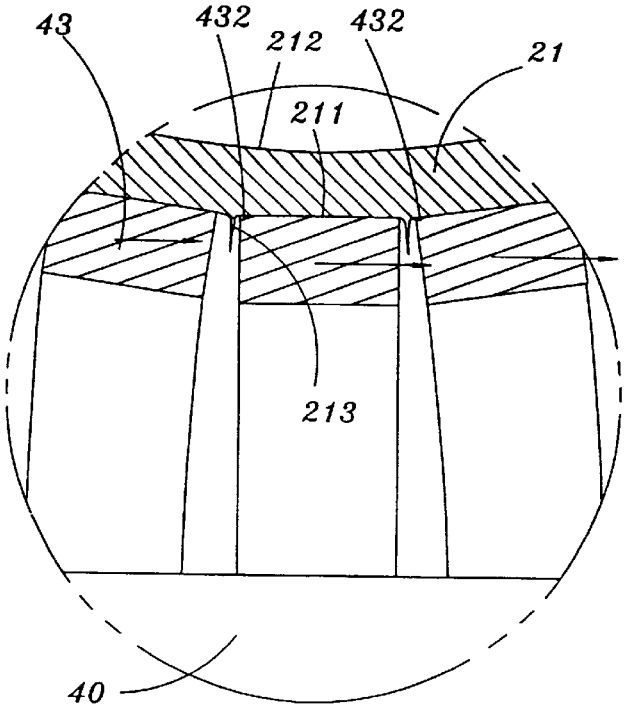
FIG. 11 is a partial enlarged sectional view showing planing of the rough edges on the shaped wall of the hole of the present invention when in the state as shown in FIG. 10.

When in taking the die core device 4 out of the inner wall 211 of the shaped article 21, the cam lever 412 of the end supporting member 41 supporting the inner spring 44 is loosened in the first place to release the mandrel 40 from restraint of the through hole 401, then taking the mandrel 40 as a guide rail, shake and draw the end supporting member 41 to and fro to take therewith the inner spring 44, now every ring of the threads on the inner spring 44 has been elastically reduced or influenced by pressure of the outer spring 43 in swaging, nevertheless, the inner spring 44 and the mandrel 40 still keep therebetween a gap making it possible to shake and draw the end supporting member 41 to render all the rings of the threads on the inner spring 44 to be removed from the outer spring 43 and to take therewith the inner spring 44 out (as shown on the left side in FIG. 10). Now, there are only the end supporting member 42 left and contact the mandrel 40 and the outer spring 43 hung on the end supporting member 42 in the inner wall 211 of the shaped article 21, the outer spring 43 and the mandrel 40 also keep therebetween a gap making it possible to be compressed in swaging (as shown on the right side in FIG. 10), wherein, the mandrel 40 is confined by the end supporting member 42, draw out the end supporting member 42 and the mandrel 40 connected therewith as well as the outer spring 43, now every ring of the threads of the outer spring 43 are ready to spread out elastically, so that a lot of rough edges 213 on the inner wall 211 formed during forging can be planed by the angled edges 432 of the rings of the threads on the outer spring 43 (as shown in FIG. 11), due to the fact that the outer spring 43 is made of spring steel, the hardness thereof is much higher than that of the inner wall 211 of the shaped article 21 made of common metallic material. Therefore, by the easy way of removing the die core device 4 of the present invention, an effect of synchronical planing on the rough edges of the inner wall 211 of the shaped article 21 and drawing out of the spring 43 can be achieved.

Figure 12:
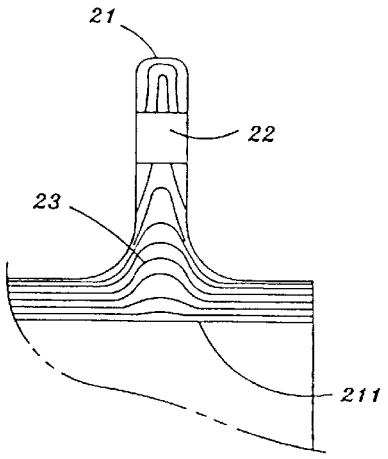
FIG. 12 is a schematic view showing partial grainfiber flow in a hollow wheel hub made by the process of the present invention.

Referring to FIG. 12, the present invention and the abovementioned conventional techniques can both be provided on the shaped article 21 with a plurality of hooking holes 22; and more especially, in forge processing with the die core device 4 of the present invention which is easy in removing, it can be observed that the grainfiber flow 23 of the shaped article 21 is arciform and is bent in a more tender mode, i.e., the texture of the crystallines of the shaped article 21 made by the present invention is more uniform than that by the conventional techniques, or the crystalline coherence in the wall of the shaped article 21 is better, and thus has a larger compression resistance.

Further, the aforementioned inner spring 44 in the inner wall 201 of the blank 20 to be forged in the die core device 4 of the present invention and the peripheral groove 414 provided on the stepped stubs 411 as well as the C shaped locking ring 46 are not limited in their amount, in fact, the amount of the springs contained in the die core device 4 depends on the desired resisting force against the swaging action. Two coaxial springs (this means the outer spring 43 and the inner spring 44) or more than two coaxial springs with different diameters (this means a plurality of inner springs 44 with different diameters can be added) can be used between the end supporting members 41, 42, these springs telescopically slipped one over another in the inner wall 211 to absorb the pressure in swaging; while the way of removing them is like the way stated above, i.e., the springs exept the outer most one hung on one of the end supporting members are in the first place removed by shaking and drawing, and then the outer most one is drawn out directly, the rough edges 213 on the inner wall 211 formed during forging can be likewise planed simultaneously, such process is extremely convenient in operation.

Having thus described my invention, what I claim as new and desire to be secured by Letters Patent of the United States are:

1. An easily removed die core device used for cold swaging comprising:

a mandrel, two end supporting members, an outer spring and at least one inner spring, said die core device is placed in a pipe shaped blank of a workpiece to be forged and is processed in a swaging operation, wherein:

said two end supporting members in said die core device said multiple inner springs coaxially arranged, while the other is used to hang said outer include means to receive ends of said inner and outer springs such that said springs are coaxially supported between said end supporting members; said mandrel is extended into a hole formed by an inner wall of said blank, and said end supporting members and said inner and outer springs are respectively placed over the two ends of said mandrel, so that said inner and outer springs are coaxially mounted between said blank to be forged and said mandrel.

2. The easily removed die core device used for cold swaging as in claim 1, wherein, said end supporting members are provided with stepped stubs used for mounting said inner and outer springs, the centers of said end supporting members are each provided with a through hole, a slit is left on one side of each of said through holes, a clamping rod is provided on one side of each of said slits, said clamping rods are connected to cam levers to control expansion and reduction of said through holes;

a number of said stepped stubs varies according to a number of said springs to be used, said stepped stubs are provided each with a peripheral groove, said peripheral grooves receive a C-shaped locking ring.

3. The easily removed die core device used for cold swaging as in claim 1, wherein, said inner and outer springs are arranged such that a direction of a spiral of said springs alternates from clockwise to counterclockwise for each successive spring.

4. The easily removed die core device used for cold swaging as in claim 1, wherein, said inner and outer springs are tension springs having a rectangular cross section, said outer spring has on lateral shoulders thereof cutting angles.

5. The easily removed die core device used for cold swaging as in claim 4, wherein, when said springs are drawn out of the shaped workpiece, rough edges formed during forging on an inner wall of said shaped workpiece are planed by said cutting angles on said outer spring as said springs are drawn out of said shaped workpiece.

* * * * *